US008102351B2

(12) United States Patent
Tang

(10) Patent No.: US 8,102,351 B2
(45) Date of Patent: Jan. 24, 2012

(54) METHOD FOR DRIVING LIQUID CRYSTAL PANEL WITH CANCELING OUT OF OPPOSITE POLARITIES OF COLOR SUB-PIXEL UNITS

(75) Inventor: Deng-Tzung Tang, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 993 days.

(21) Appl. No.: 12/011,666

(22) Filed: Jan. 28, 2008

(65) Prior Publication Data

US 2008/0180378 A1 Jul. 31, 2008

(30) Foreign Application Priority Data

Jan. 26, 2007 (CN) ..... 2007 1 0073126

(51) Int. Cl.
*G09G 3/36* (2006.01)
*G09G 5/10* (2006.01)

(52) U.S. Cl. ..... 345/96; 345/89; 345/209; 345/690; 345/694

(58) Field of Classification Search ..... 345/89, 345/96, 209, 690, 694
See application file for complete search history.

(56) References Cited

U.S. PATENT DOCUMENTS

| | | | | |
|---|---|---|---|---|
| 6,342,876 | B1 | 1/2002 | Kim | |
| 2004/0017344 | A1 * | 1/2004 | Takemoto | 345/87 |
| 2004/0125117 | A1 | 7/2004 | Suzuki et al. | |
| 2004/0183768 | A1 * | 9/2004 | Yamato et al. | 345/98 |
| 2005/0057173 | A1 | 3/2005 | Suzuki et al. | |
| 2005/0093806 | A1 * | 5/2005 | Hosotani | 345/96 |
| 2006/0202927 | A1 * | 9/2006 | Lee | 345/88 |
| 2008/0231592 | A1 * | 9/2008 | Johnson et al. | 345/107 |

FOREIGN PATENT DOCUMENTS

| | | | |
|---|---|---|---|
| TW | 200504658 | A | 2/2005 |
| TW | 200617847 | A | 6/2006 |
| TW | 200620201 | A | 6/2006 |

* cited by examiner

*Primary Examiner* — Amr Awad
*Assistant Examiner* — Jonathan Boyd
(74) *Attorney, Agent, or Firm* — Altis Law Group, Inc.

(57) ABSTRACT

An exemplary method for driving a liquid crystal panel includes: defining the array of pixels as comprising an array of dithering units; providing a predetermined inversion driving pattern for each dithering unit; providing a series of predetermined dithering patterns for each dithering unit; driving the sub-pixel units according to a sequence of frames, a predetermined plurality of the frames defining a cycle of frames. For all the first, second, and third color sub-pixels in a same row of pixels of each dithering unit, summations of the polarities of the first, second, and third color sub-pixels cancel each other out, respectively.

8 Claims, 5 Drawing Sheets

METHOD FOR DRIVING LIQUID CRYSTAL PANEL WITH CANCELING OUT OF OPPOSITE POLARITIES OF COLOR SUB-PIXEL UNITS

FIELD OF THE INVENTION

The present invention relates to a method for driving a liquid crystal panel, wherein both an inversion driving method and a dynamic dithering method are employed simultaneously.

GENERAL BACKGROUND

A liquid crystal display (LCD) has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions. An LCD usually includes a liquid crystal panel configured for color image display. With the ongoing growth of the LCD industry, consumers' requirements for good display performance of color images are becoming more demanding.

Generally, the display performance of a color image is measured and determined by an amount of bits ("bit amount") in every single color channel of a liquid crystal panel. For example, if a liquid crystal panel has 6 bits for a single color channel, the liquid crystal panel can display a $2^6$ (64) gray scale color image in the single color channel. Such liquid crystal panel is called a 6-bit panel. A typical liquid crystal panel includes a red channel, a green channel, and a blue channel, therefore a total amount of 262,144 (=64×64×64) different colors can be displayed by the liquid crystal panel. An 8-bit panel can display 256 gray scales in each single color channel, and therefore can display 16,777,216 (about 16.7 million) different colors. That is, theoretically, the total amount of different colors that a 6-bit panel can display is less than 2% of the total amount of different colors that an 8-bit panel can display. Thus the 8-bit panel should have better display performance of color images than a 6-bit panel, because the 8-bit panel can display more colors. In particular, the 8-bit panel can provide brighter and more vivid images for viewers.

The bit amount of a liquid crystal panel is related to driving channels of a driving circuit employed in the liquid crystal panel. A driving circuit of a 6-bit panel has only 64 driving channels. On the one hand, the 6-bit panel may not display very high quality color images. On the other hand, the 6-bit panel can be easy to configure and cost-effective. From a structural point of view of liquid crystal panels, the 6-bit panel has 64 different gray scales between pure black and pure white. Therefore the display of the 6-bit panel can be more easily controlled. In particular, the 6-bit panel has a relatively fast response time, for example between 6 milliseconds and 12 milliseconds.

Typically, color enhancement technology is employed in a 6-bit panel in order that the 6-bit panel can display more colors. The color enhancement technology usually involves a pixel dithering method or a frame rate control method. By adopting such color enhancement technology, the 6-bit panel can display as many as 16.2 million colors.

Referring to FIG. 3, this illustrates a simple principle of the pixel dithering method. Each small square represents a pixel of a typical 6-bit panel. Four pixels in the form of 2×2 matrix constitute a dithering unit. In order to simplify the following explanation of the dithering method, it is assumed that each of the four pixels can only display a white color or a black color. In FIG. 3, a white color is shown as a blank area, and a black color is shown as a hatched area. A gray scale of the white color is defined as "0", a gray scale of the black color is defined as "1", and a pattern corresponding to the four pixels' gray scales is defined as a dithering pattern. As shown in FIG. 3, the dithering units from left to right sequentially have a gray scale of "1", "¾", "½", "¼", and "0". Therefore four pixels cooperatively can display 5 different gray scales, with each pixel displaying only white or black. In other examples, the dithering unit can have more than four pixels. The more pixels the dithering unit has, the more dithering patterns the dithering unit has, such that more gray scales can be displayed.

However, a liquid crystal panel using the above-described dithering method is prone to display images with low uniformity. To mitigate this problem, a dynamic pixel dithering method can be employed. Referring to FIG. 4, this illustrates a simple principle of the dynamic pixel dithering method. In one dithering unit, three pixels are white and one pixel is black. Four different dithering patterns are provided, each corresponding to a gray scale of ¼. The four dithering patterns are switched from one to the other swiftly. Thus the four dithering patterns are essentially equivalent to one image with a gray scale of ¼ as seen by a viewer, because of a so-called visual staying phenomenon.

The 8-bit panel can provide 256 different gray scales of 0~255, and the 6-bit panel can only provide 64 different gray scales of 0~63. Therefore, a simulating method is adopted to help increase the amount of gray scales of the 6-bit panel. Two bits of "0" are added to the end of the 6 bit binary number of each gray scale to generate an 8 bit binary number. Thereby, the 6-bit panel can provide gray scales of 0, 4, 8, 12, . . . 248, 252, which are defined as valid gray scales.

| 6 bit | 8 bit |
|---|---|
| 63 = 111111 | 11111100 = 252 |
| 62 = 111110 | 11111000 = 248 |
| . . . | . . . |
| 1 = 000001 | 00000100 = 4 |
| 0 = 000000 | 00000000 = 0 |

The gray scales among the valid gray scales can be achieved by adopting the dynamic dithering method. Referring to FIG. 5, each small square represents a pixel, and four pixels in the form of a 2×2 matrix constitute a dithering unit. Each dithering unit shows a particular dithering pattern. The four dithering patterns are switched from one to the other rapidly in order to be perceived by a viewer as an image of a desired gray scale. For example, if a gray scale of 249 is desired, three pixels of the dithering unit each display a gray scale of 248 (shown as blank areas in FIG. 5), and the other one pixel of the dithering unit displays a gray scale of 252 (shown with hatching in FIG. 5). Therefore, the four dithering patterns cooperatively display a gray scale of 249. Other gray scales can be displayed according to the same principles. Thus, the 6-bit panel can provide 253 different gray scales from 0 to 252.

In general, liquid crystal molecules are utilized to control light transmission at each of pixel regions of the liquid crystal panel. A typical pixel region includes a red sub-pixel region, a green sub-pixel region, and a blue sub-pixel region. The liquid crystal molecules are driven according to external video signals received by the liquid crystal panel. A conventional liquid crystal panel generally employs a selected one of a frame inversion system, a line inversion system, or a dot inversion system to drive the liquid crystal molecules. Each of these driving systems can protect the liquid crystal molecules from decay or damage.

In the following description, unless the context indicates otherwise, a reference to a "sub-pixel" is a reference to a sub-pixel region.

A typical method employed in the dot inversion system is known as a 2-line inversion driving method. That is, a polarity of each sub-pixel in a first row of the sub-pixels is the same as that of an adjacent sub-pixel in a second row of the sub-pixels. A polarity of each sub-pixel in a third row of the sub-pixels is the same as that of an adjacent sub-pixel in a fourth row of the sub-pixels, and is opposite to that of an adjacent sub-pixel in the second row. Polarities of the sub-pixels in each column of the sub-pixels are opposite to the polarities of the sub-pixels in both adjacent columns. Moreover, the polarity of each sub-pixel is reversed once in every frame period.

By adopting the 2-line inversion driving method, the polarity of each sub-pixel in a current frame is opposite to that in the previous frame and opposite to that in the next frame. Thereby, liquid crystal molecules of the liquid crystal panel avoid decay or damage.

Referring to FIG. 6, another typical method employed in the dot inversion system is known as a 1-2 line inversion driving method. The 1-2 line inversion driving method is similar to the 2-line inversion method, except that a single row of sub-pixels is arranged as the first row. The sub-pixels of the first row have opposite polarities to the sub-pixels of the second row. From the second row down, the sub-pixels are driven according to the 2-line inversion driving method.

In general, a typical liquid crystal panel has a refresh rate of 60 frames per second. That is, 60 frames are displayed during a single second. Usually, the naked human eye cannot distinguish between two different frames if the refresh rate is over 30 frames per second.

Referring to FIG. 7, a typical liquid crystal panel 10 includes a first substrate (not shown), a second substrate (not shown) parallel to the first substrate, a liquid crystal layer (not shown) sandwiched between the first and second substrates, a scanning driving circuit 11, and a data driving circuit 12.

The first substrate includes a plurality of scanning lines 13 that are parallel to each other, a plurality of data lines 14 that are parallel to each other and perpendicularly intersecting with but insulated from the scanning lines 13, a plurality of pixel electrodes 151, and a plurality of thin film transistors 15 each arranged in the vicinity of a respective point of intersection of the scanning lines 13 and the data lines 14. The scanning driving circuit 11 is configured for providing a plurality of scanning signals to the scanning lines 13. The data driving circuit 12 is configured for providing a plurality of gray scale voltages to the data lines 14. A minimum area cooperatively defined by two adjacent scanning lines 13 and two adjacent data lines 14 is defined as a sub-pixel (not labeled). The second substrate includes a plurality of common electrodes 152 corresponding to the pixel electrodes 151 respectively. Each thin film transistor 15 includes a gate electrode (not labeled) connected to the corresponding scanning line 13, a source electrode (not labeled) connected to the corresponding data line 14, and a drain electrode (not labeled) connected to a corresponding pixel electrode 151.

When a scanning signal is applied to the gate electrode of each thin film transistor 15 via the corresponding scanning line 13, the thin film transistor 15 is activated. A gray scale voltage is applied to the corresponding pixel electrode 151 via the corresponding source electrode and drain electrode. The corresponding common electrode 152 has a common voltage applied thereto. Therefore, an electrical field is generated between the pixel electrode 151 and the common electrode 152. The liquid crystal molecules in the electrical field are twisted such that light rays are allowed to pass through. When the gray scale voltage is greater than the common voltage, a directionality of the electrical field is from the pixel electrode 151 to the common electrode 152, and the sub-pixel is defined as having a positive polarity. Conversely, when the gray scale voltage is less than the common voltage of the common electrode 152, the directionality of the electrical field is from the common electrode 152 to the pixel electrode 151, and the sub-pixel is defined as having a negative polarity. Moreover, when absolute values of the gray scale voltages applied to the pixel electrodes 151 of two sub-pixels are the same, with the gray scale voltages only differing in polarity, the gray scales of the two sub-pixels are assumed to be the same.

Because the common electrodes 152 have different inherent resistances, the actual common voltages applied to the common electrodes 152 are slightly different from each other, and are either more or less than an ideal common voltage. Due to the differences between the actual common voltages and the ideal common voltage, strip lines may occur in an image displayed by the liquid crystal panel 10.

Referring to FIG. 8, each small square represents a sub-pixel of the liquid crystal panel 10. The sub-pixels in each same row of the sub-pixels are arranged in a sequence of repeating red, green, and blue ("RGB") sub-pixel groups. Thus the sub-pixels of each column of the sub-pixels are capable of displaying a same color. In each row, each group of a red sub-pixel, an adjacent green sub-pixel, and an adjacent blue sub-pixel cooperatively constitutes a pixel region. In the following description, unless the context indicates otherwise, a reference to a "pixel" is a reference to a pixel region. Each group of four pixels adjacent to each other in the form of a 2×2 matrix constitutes a dithering unit. The liquid crystal panel 10 is a normal white mode panel. Therefore, the greater the gray scale voltage applied, the less the amount of light rays that can pass through the corresponding sub-pixel.

The liquid crystal panel 10 employs an inversion driving method and a dynamic dithering method simultaneously. The inversion driving method employed by the liquid crystal panel 10 is a 1-2 line inversion driving method. The dynamic dithering method employed by the liquid crystal panel 10 is detailed as follows:

In the first frame, the upper-left pixel of each dithering unit displays a first gray scale of M (shown with hatching in FIG. 8), and the upper-right pixel, the lower-left pixel, and the lower-right pixel of each dithering unit display a second gray scale of N (shown with a blank background in FIG. 8).

In the second frame, the lower-right pixel of each dithering unit displays the first gray scale of M, and the other pixels of each dithering unit display the second gray scale of N.

In the third frame, the lower-left pixel of each dithering unit displays the first gray scale of M, and the other pixels of each dithering unit display the second gray scale of N.

In the fourth frame, the upper-right pixel of each dithering unit displays the first gray scale of M, and the other pixels of each dithering unit display the second gray scale of N.

The liquid crystal panel 10 repeats displaying from the first frame through the fourth frame again and again. The actual image as viewed by the naked human eye has a dithering gray scale of (M+3N)/4. For example, if M is equal to 252 and N is equal to 248, then a gray scale of 249 is dithered.

The liquid crystal panel 10 is also driven by the 1-2 line inversion driving method. The following text shows summations of the polarities of the pixels that display the first gray scale of M, from the first frame through the fourth frame, for each row of the pixels:

the first row: $(R^{+}+G^{-}+B^{+})+(R^{+}+G^{-}+B^{+})=2R^{+}+2G^{-}+2B^{+}$;

the second row: $(R^{-}+G^{+}+B^{-})+(R^{-}+G^{+}+B^{-})=2R^{-}+2G^{+}+2B^{-}$;

the third row: $(R^{-}+G^{+}+B^{-})+(R^{-}+G^{+}+B^{-})=2R^{-}+2G^{+}+2B^{-}$, the fourth row: $(R^{+}+G^{-}+B^{+})+(R^{+}+G^{-}+B^{+})=2R^{+}+2G^{-}+2B^{+}$;

the fifth row: $(R^{+}+G^{-}+B^{+})+(R^{+}+G^{-}+B^{+})=2R^{+}+2G^{-}+2B^{+}$; and the sixth row: $(R^{-}+G^{+}+B^{-})+(R^{-}+G^{+}+B^{-})=2R^{-}+2G^{+}+2B^{-}$.

The sums of the polarities of the sub-pixels in the second row and in the third row are the same, and the sums of the polarities of the pixels in the fourth row and in the fifth row are the same. When the actual common voltage is lower than the ideal common voltage, the red and blue sub-pixels of the pixels of the second row each have a gray scale voltage less than a desired gray scale voltage, and the green sub-pixels of the pixels of the second row each have a gray scale voltage greater than a desired gray scale voltage. Therefore the second row exhibits purple color shift. The polarities of the sub-pixels of the first row are opposite to the polarities of the sub-pixels of the second row. Therefore the first row exhibits green color shift. However, to the naked human eye, the color shifts of the first and second rows counteract each other, and the displayed image appears normal. The polarities of the sub-pixels of the third row are the same as the polarities of the sub-pixels of the second row. Therefore the third row exhibits purple color shift, just like the second row. As a result, a purple strip line between the second row and the third row is visible to the naked human eye.

In summary, because the actual common voltages are slightly different from the ideal common voltage, images displayed by the liquid crystal panel 10 are liable to have visible strip lines. That is, the color image display performance of the liquid crystal panel 10 is impaired.

What is needed, therefore, is a method for driving a liquid crystal panel which can overcome the above-described deficiencies.

SUMMARY

An method for driving a liquid crystal panel, the liquid crystal panel comprising a plurality of sub-pixel units, the sub-pixel units includes sub-pixel units of a first color, sub-pixel units of a second color, and sub-pixel units of a third color arranged in a regular, repeating array, each three adjacent sub-pixel units having the first color, the second color, and the third color defining a pixel, the method includes: defining the array of pixels as comprising an array of dithering units, each dithering unit comprising a same plurality of pixels; providing a predetermined inversion driving pattern for each dithering unit, wherein a polarity of each sub-pixel unit of the dithering unit is reversed at least once, and the completion of the at least one reversal of every sub-pixel unit defines a cycle of the inversion driving pattern; providing a series of predetermined dithering patterns for each dithering unit, wherein each dithering unit is capable of displaying at least two predetermined gray scales, and the series of predetermined dithering patterns defines a cycle of dithering patterns; driving the sub-pixel units according to a sequence of frames, a predetermined plurality of the sequential frames defining a cycle of frames, wherein in each cycle of frames, the polarity of each sub-pixel unit of each dithering unit is reversed according to the cycle of the inversion driving pattern, and the pixels of each dithering unit are dithered according to the cycle of dithering patterns, such that on the completion of each cycle of frames, for all the first color sub-pixel units in a same row of pixels of each dithering unit, a summation of the polarities of the first color sub-pixel units is that the polarities cancel each other out, for all the second color sub-pixel units in a same row of pixels of each dithering unit, a summation of the polarities of the second color sub-pixel units is that the polarities cancel each other out, and for all the third color sub-pixel units in a same row of pixels of each dithering unit, a summation of the polarities of the third color sub-pixel units is that the polarities cancel each other out.

Other novel features and advantages will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
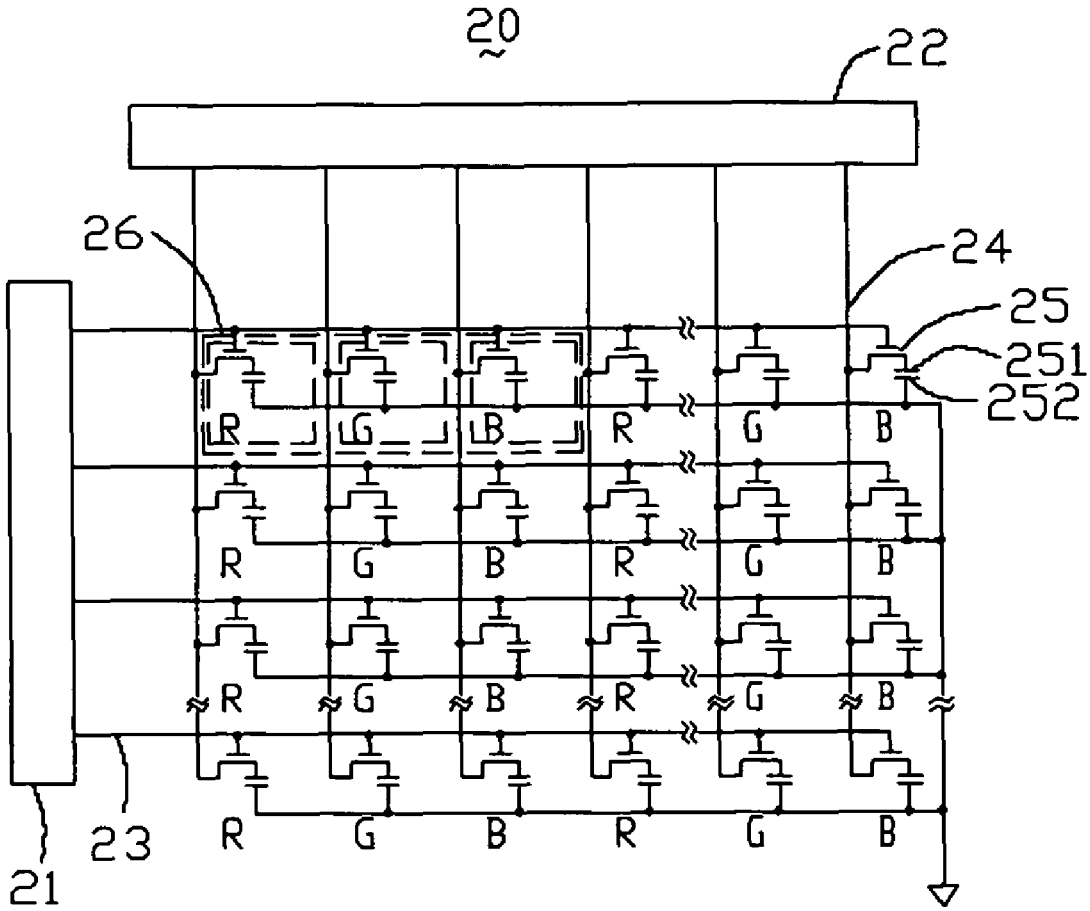
FIG. 1 is essentially an abbreviated circuit diagram of a liquid crystal panel according to an exemplary embodiment of the present invention, the liquid crystal panel including a plurality of dithering units.

Referring to FIG. 1, a liquid crystal panel 20 according to an exemplary embodiment of the present invention is shown. The liquid crystal panel 20 includes a first substrate (not shown), a second substrate (not shown) parallel to the first substrate, a liquid crystal layer (not shown) sandwiched between the first substrate and the second substrate, a scanning driving circuit 21, and a data driving circuit 22.

The first substrate includes a plurality of scanning lines 23 that are parallel to each other, a plurality of data lines 24 that are parallel to each other and perpendicularly intersecting with but insulated from the scanning lines 23, a plurality of pixel electrodes 251, and a plurality of thin film transistor 25 each arranged in the vicinity of a respective point of intersection of the scanning lines 23 and the data lines 24. The scanning driving circuit 21 is configured for providing a plurality of scanning signals to the scanning lines 23. The data driving circuit 22 is configured for providing a plurality of gray scale voltages to the data lines 24. A minimum area cooperatively defined by two adjacent scanning lines 23 and two adjacent data lines 24 is defined as a sub-pixel (not labeled). The second substrate includes a plurality of common electrodes 252 corresponding to the pixel electrodes 251 respectively. Each thin film transistor 25 includes a gate electrode (not labeled) connected to the corresponding scanning line 23, a source electrode (not labeled) connected to the corresponding data line 24, and a drain electrode (not labeled) connected to a corresponding pixel electrode 251.

When a scanning signal is applied to the gate electrode of each thin film transistor 25 via the corresponding scanning line 23, the thin film transistor 25 is activated. A gray scale voltage is applied to the corresponding pixel electrode 251 via the corresponding source electrode and drain electrode. The corresponding common electrode 252 has a common voltage applied thereto. Therefore, an electrical field is generated between the pixel electrode 251 and the common electrode 252. The liquid crystal molecules in the electrical field are twisted such that light rays are allowed to pass through.

A directionality of the electrical field needs to be varied periodically, in order that decay of or damage to the liquid crystal molecules can be avoided. The present embodiment provides a method for driving the liquid crystal panel 20 to accomplish such requirement, as follows. To simplify the explanation, the following definitions are used. When the gray scale voltage is greater than the common voltage of the common electrode 252, a directionality of the electrical field is from the pixel electrode 251 to the common electrode 252, and the sub-pixel is defined as having a positive polarity. Conversely, when the gray scale voltage is less than the common voltage of the common electrode 252, the directionality of the electrical field is from the common electrode 252 to the pixel electrode 251, and the sub-pixel is defined as having a negative polarity. Moreover, when absolute values of the gray scale voltages applied to the pixel electrodes 251 of two sub-pixels are the same, with the gray scale voltages only differing in polarity, the gray scales of the two sub-pixels are assumed to be the same.

The sub-pixels in each same row of the sub-pixels are arranged in a sequence of repeating RGB sub-pixel groups. Thus the sub-pixels in each column of the sub-pixels are capable of displaying the same color. In each row, each group of a red sub-pixel, an adjacent green sub-pixel, and an adjacent blue sub-pixel cooperatively constitutes a pixel 26. All the pixels 26 of the liquid crystal panel 20 are arranged as a plurality of dithering units (not labeled). Each of the dithering units includes four pixels 26 adjacent to each other in the form of a 2×2 matrix.

Figure 2:
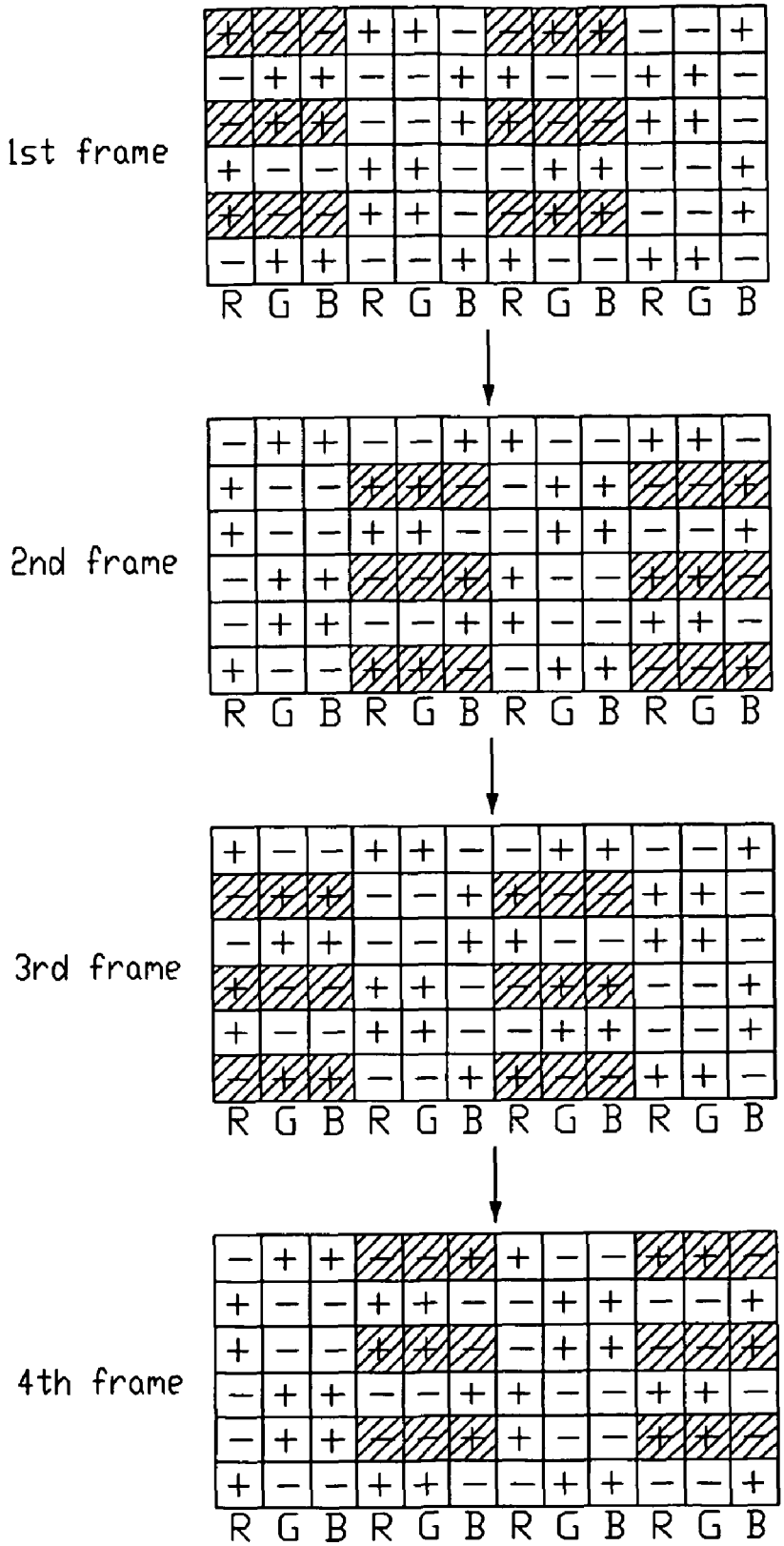
FIG. 2 illustrates a series of dithering patterns of six dithering units of the liquid crystal panel of FIG. 1, each of the dithering units comprised of four RGB pixels arranged in a 2×2 matrix, the six dithering units arranged in a matrix of 3 rows and 2 columns.
Figure 3:
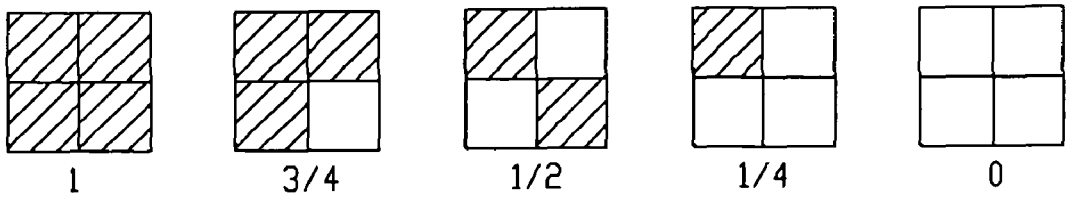
FIG. 3 (RELATED ART)
FIG. 3 is a schematic view of dithering units of a conventional liquid crystal panel, illustrating a principle of a pixel dithering method.
Figure 4:
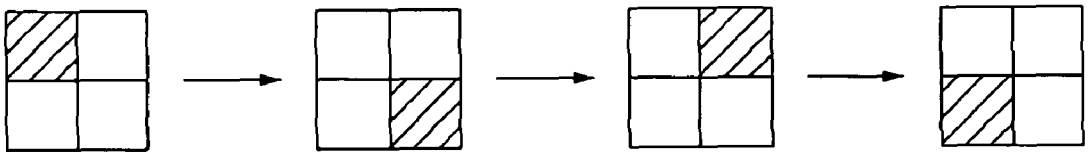
FIG. 4 (RELATED ART)
FIG. 4 is a schematic view of dithering units of a conventional liquid crystal panel, illustrating a principle of a dynamic pixel dithering method.
Figure 5:
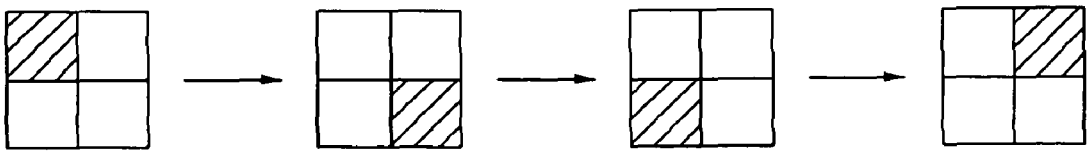
FIG. 5 (RELATED ART)
FIG. 5 is a schematic view of dithering units of a conventional liquid crystal panel, illustrating a principle of displaying a predetermined gray scale in a dithering unit.
Figure 6:
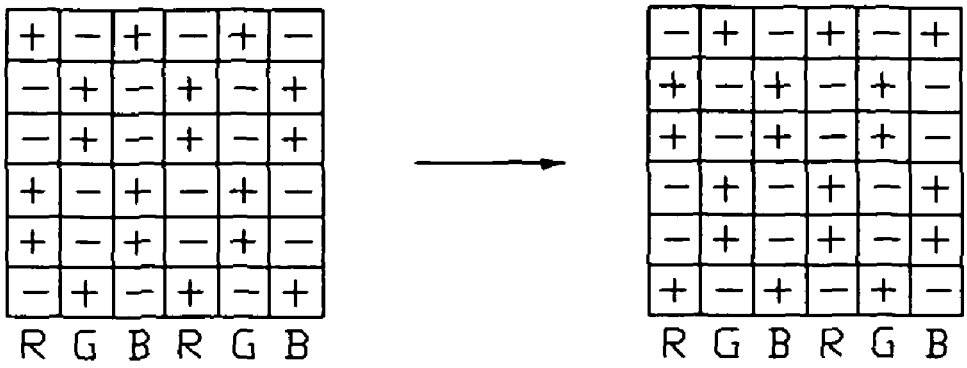
FIG. 6 (RELATED ART)
FIG. 6 is a schematic view of an array of sub-pixels of a conventional liquid crystal panel, illustrating a principle of a 1-2 line inversion driving method.
Figure 7:
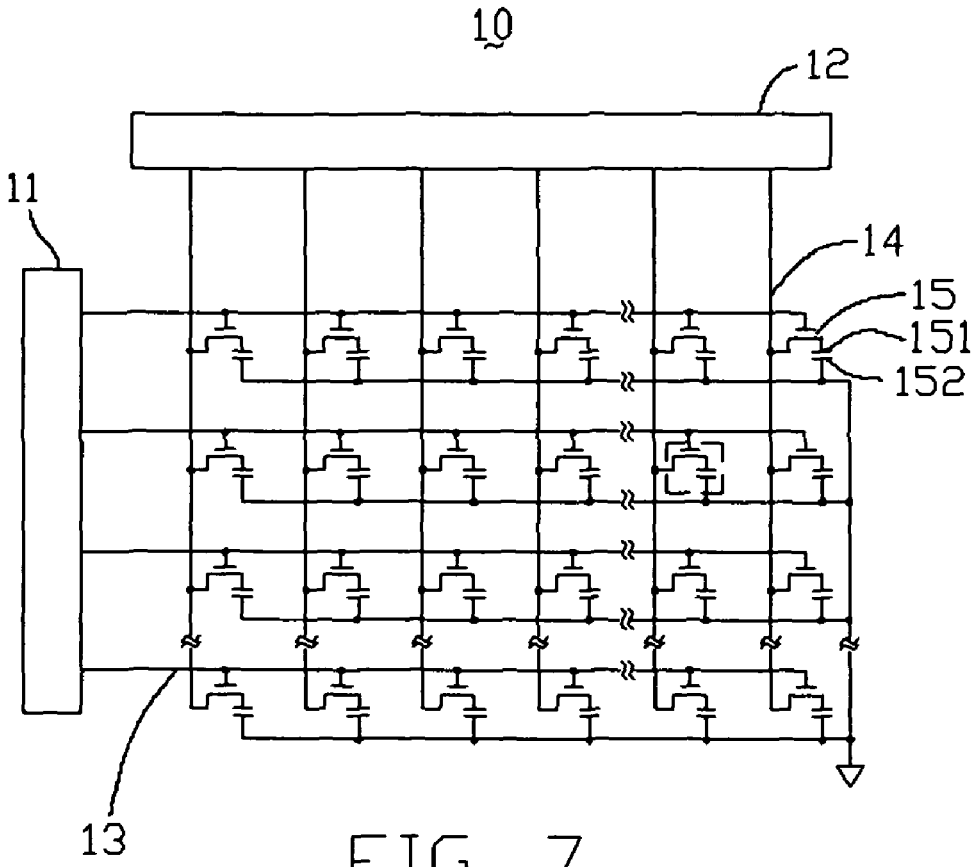
FIG. 7 (RELATED ART)
FIG. 7 is essentially an abbreviated circuit diagram of a conventional liquid crystal panel.
Figure 8:
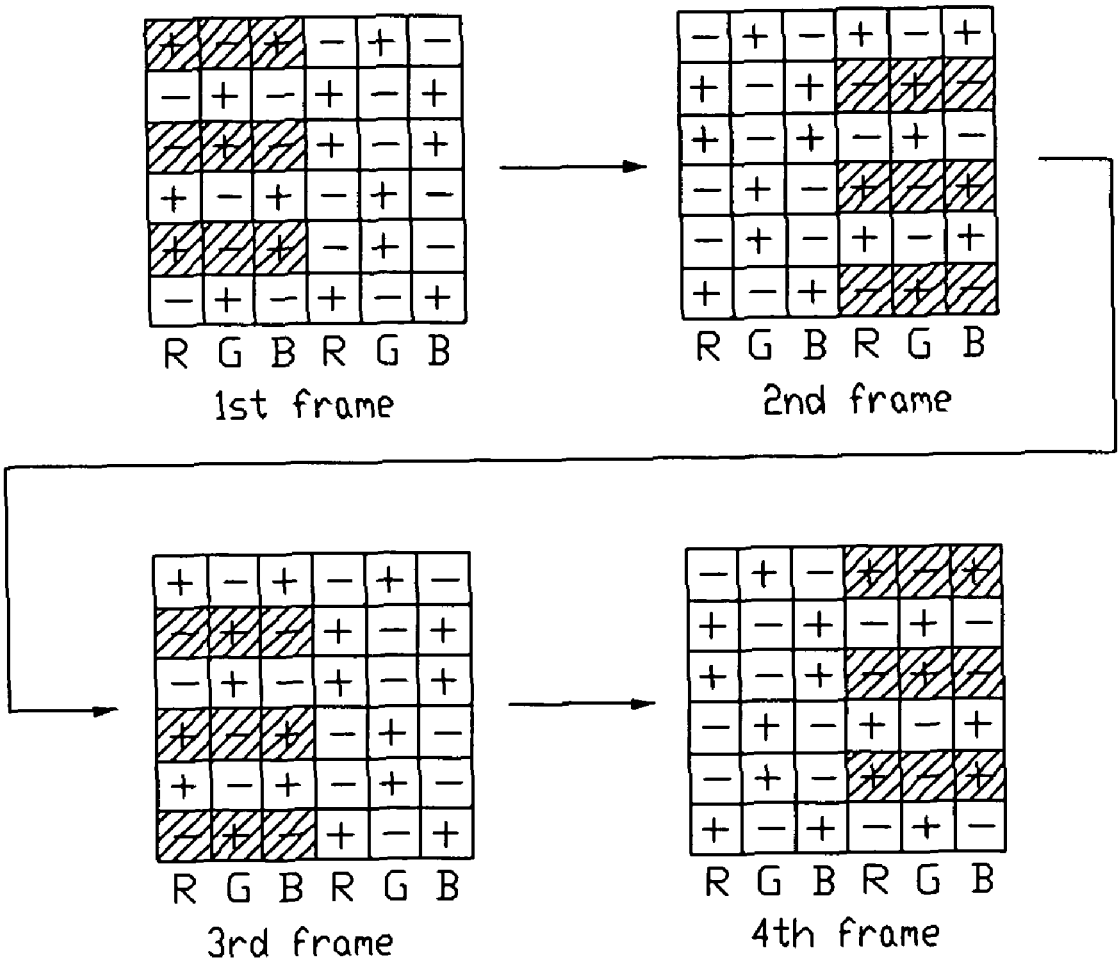
FIG. 8 (RELATED ART)
FIG. 8 illustrates a series of dithering patterns of three dithering units of the liquid crystal panel of FIG. 7, each of the dithering units comprised of four RGB pixels arranged in a 2×2 matrix, the three dithering units arranged in a matrix of 3 rows and 1 column.

Referring also to FIG. 2, the liquid crystal panel 20 employs an inversion driving method and a dynamic dithering method simultaneously. Each small square in FIG. 2 represents a sub-pixel.

In this embodiment, the liquid crystal panel 20 employs a 1-2 line inversion driving method along both the row direction and the column direction. That is, a polarity of each sub-pixel in a second row of the sub-pixels is the same as that of an adjacent sub-pixel in a third row of the sub-pixels, and is opposite to that of an adjacent sub-pixel in a first row of the sub-pixels. A polarity of each sub-pixel in a fourth row of the sub-pixels is the same as that of an adjacent sub-pixel in a fifth row of the sub-pixels, and is opposite to that of an adjacent sub-pixel in the third row of the sub-pixels. A polarity of each sub-pixel in a second column of the sub-pixels is the same as that of an adjacent sub-pixel in a third column of the sub-pixels, and is opposite to that an adjacent sub-pixel in a first column of the sub-pixels. A polarity of each sub-pixel in a fourth column of the sub-pixels is the same as that of an adjacent sub-pixel in a fifth column of the sub-pixels, and is opposite to that of an adjacent sub-pixel in the third column of the sub-pixels. Moreover, the polarity of each sub-pixel is reversed once in each frame period.

The dynamic dithering method employed by the liquid crystal display is described in detail as follows:

In the first frame, the upper-left pixel of each dithering unit displays a first gray scale of M (shown with hatching in FIG. 2), and the upper-right pixel, the lower-left pixel, and the lower-right pixel of each dithering unit display a second gray scale of N (shown with a blank background in FIG. 2).

In the second frame, the lower-right pixel of each dithering unit displays the first gray scale of M, and the other pixels of each dithering unit display the second gray scale of N.

In the third frame, the lower-left pixel of each dithering unit displays the first gray scale of M, and the other pixels of each dithering unit display the second gray scale of N.

In the fourth frame, the upper-right pixel of each dithering unit displays the first gray scale of M, and the other pixels of each dithering unit display the second gray scale of N.

The liquid crystal panel 20 repeats displaying from the first frame through the fourth frame again and again. Each frame from the first frame to the fourth frame corresponds to a different dithering pattern. The actual image as viewed by the naked human eye has a dithering gray scale of (M+3N)/4. For example, if M is equal to 252, and N is equal to 248, then a gray scale of 249 is dithered.

The following text shows summations of the polarities of the pixels that display the first gray scale of M, from the first frame through the fourth frame, for each row of pixels:

the first row: $(R^{+}+G^{-}+B^{-}+R^{-}+G^{+}+B^{+})+(R^{-}+G^{-}+B^{+}+R^{+}+G^{+}+B^{-})=2R^{+}+2R^{-}+2B^{+}+2B^{-}+2G^{+}+2G^{-}$;

the second row: $(R^{+}+G^{+}+B^{-}+R^{-}+G^{-}+B^{+})+(R^{-}+G^{+}+B^{+}+R^{+}+G^{-}+B^{-})=2R^{+}+2R^{-}+2B^{+}+2B^{-}+2G^{+}+2G^{-}$;

the third row: $(R^{-}+G^{+}+B^{+}+R^{+}+G^{-}+B^{-})+(R^{+}+G^{+}+B^{-}+R^{-}+G^{-}+B^{+})=2R^{+}+2R^{-}+2B^{+}+2B^{-}+2G^{+}+2G^{-}$;

the fourth row: $(R^{-}+G^{-}+B^{+}+R^{+}+G^{+}+B^{-})+(R^{+}+G^{-}+B^{-}+R^{-}+G^{+}+B^{+})=2R^{+}+2R^{-}+2B^{+}+2B^{-}+2G^{+}+2G^{-}$;

the fifth row: $(R^{+}+G^{-}+B^{-}+R^{-}+G^{+}+B^{+})+(R^{-}+G^{-}+B^{+}+R^{+}+G^{+}+B^{-})=2R^{+}+2R^{-}+2B^{+}+2B^{-}+2G^{+}+2G^{-}$; and the sixth row: $(R^{+}+G^{+}+B^{-}+R^{-}+G^{-}+B^{+})+(R^{-}+G^{+}+B^{+}+R^{+}+G^{-}+B^{-})=2R^{+}+2R^{-}+2B^{+}+2B^{-}+2G^{+}+2G^{-}$.

As seen, for each row of the sub-pixels, the polarities of the red sub-pixels displaying the first gray scale of M cancel each other out, the polarities of the green sub-pixels displaying the first gray scale of M cancel each other out, and the polarities of the blue sub-pixels displaying the first gray scale of M cancel each other out. Thus for each row of the pixels 26, the polarities of the pixels 26 cancel each other out. Accordingly, even if the actual common voltage at any of the sub-pixels is greater or less than the ideal common voltage, an image displayed by the liquid crystal panel 20 has little or no color shift and few or no color strip lines.

In an alternative embodiment, the liquid crystal panel 20 can employ a 2-line inversion driving method along both the row direction and the column direction of the pixels.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A method for driving a liquid crystal panel, the liquid crystal panel comprising a plurality of sub-pixel units, the sub-pixel units comprising sub-pixel units of a first color, sub-pixel units of a second color, and sub-pixel units of a third color arranged in a regular, repeating array, each three adjacent sub-pixel units having the first color, the second color, and the third color defining a pixel, the method comprising:

defining the array of pixels as comprising an array of dithering units, each dithering unit comprising a same plurality of pixels;

providing a predetermined inversion driving pattern for each dithering unit, wherein a polarity of each sub-pixel unit of the dithering unit is reversed at least once, and the completion of the at least one reversal of every sub-pixel unit defines a cycle of the inversion driving pattern;

providing a series of predetermined dithering patterns for each dithering unit, wherein each dithering unit is capable of displaying at least two predetermined gray scales, and the series of predetermined dithering patterns defines a cycle of dithering patterns;

driving the sub-pixel units according to a sequence of frames, a predetermined plurality of the sequential frames defining a cycle of frames, wherein in each cycle of frames, the polarity of each sub-pixel unit of each dithering unit is reversed according to the cycle of the inversion driving pattern, and the pixels of each dithering unit are dithered according to the cycle of dithering patterns, wherein in each frame, each row and each column of sub-pixel units in the array of pixels has a pattern of positive and negative polarities, and both the polarities of the sub-pixels at rows and the polarities of sub-pixels at columns are changed according to a 1-2 line driving method, wherein according to any three adjacent rows of sub-pixel units, one row of sub-pixel units adjacent to the middle row of sub-pixel units has a same pattern of positive and negative polarities with the middle row of sub-pixel units, the other row of the sub-pixel units adjacent to the middle row of sub-pixel units has a pattern of positive and negative polarities reversed to the pattern of positive and negative polarities of the middle row of sub-pixel units, at the same time, according to any three adjacent columns of sub-pixel units, one column of sub-pixel units adjacent to the middle column of sub-pixel units has a same pattern of positive and negative polarities with the middle column of sub-pixel units, the other column of sub-pixel units adjacent to the middle column of sub-pixel units has a pattern of positive and negative polarities reversed to the pattern of positive and negative polarities of the middle column of sub-pixel units, and the polarity of each sub-pixel unit in the array of pixels is reversed at each frame.

2. The method in claim 1, wherein the first, second, and third color sub-pixel units are red, green, and blue sub-pixel units respectively.

3. The method in claim 2, wherein each of the pixels comprises a red sub-pixel unit, a green sub-pixel unit, and a blue sub-pixel unit arranged sequentially.

4. The method in claim 1, wherein each of the dithering units comprises four pixels arranged in the form of a 2.times.2 matrix.

5. The method in claim 4, wherein in sixteen pixels arranged in a form of a 4×4 matrix formed by four dithering units adjacent to each other, a first row of the sub-pixel units has a pattern of positive and negative polarities opposite to a pattern of positive and negative polarities of a second row of the sub-pixel units adjacent to the first row of the sub-pixel units, a third row of the sub-pixel units has the same pattern of positive and negative polarities with the second row of the sub-pixel units, a fourth row of the sub-pixel units has a pattern of positive and negative polarities opposite to the pattern of positive and negative polarities of the third row of the sub-pixel units, and simultaneously, a first column of the sub-pixel units has a pattern of positive and negative polarities opposite to a pattern of positive and negative polarities of a second column of the sub-pixel units, a third column of the sub-pixel units has the same pattern of positive and negative polarities with the second column of the sub-pixel units, and a fourth column of the sub-pixel units has a pattern of positive and negative polarities opposite to the pattern of positive and negative polarities of the third column of the sub-pixel units.

6. The method in claim 5, wherein each cycle of dithering patterns corresponds to a cycle of four continuous frames.

7. The method in claim 6, wherein in a first one of the four continuous frames, an upper-left pixel of each dithering unit displays a first one of the predetermined gray scales, and an upper-right pixel, a lower-left pixel, and a lower-right pixel of the dithering unit display a second one of the predetermined gray scales; in a second one of the four continuous frames, the lower-right pixel of the dithering unit displays the first gray scale, and the other three pixels display the second gray scale; in a third one of the four continuous frames, the lower-left pixel of the dithering unit displays the first gray scale, and the other three pixels display the second gray scale; and in a fourth one of the four continuous frames, the upper-right pixel of the dithering unit displays the first gray scale, and the other three pixels display the second gray scale.

8. The method in claim 1, wherein the liquid crystal panel further comprises a plurality of scanning lines parallel to each other and a plurality of data lines parallel to each other and intersecting with the scanning lines, the scanning lines and the data lines cooperatively defining the sub-pixel units.

* * * * *